US008229308B2

(12) United States Patent
Shinichi

(10) Patent No.: US 8,229,308 B2
(45) Date of Patent: Jul. 24, 2012

(54) IMAGE FORMING APPARATUS AND CONTROL METHOD THEREOF

(75) Inventor: Hisatomi Shinichi, Suwon-si (KR)

(73) Assignee: Samsung Electronics Co. Ltd., Suwon-si (KR)

( * ) Notice: Subject to any disclaimer, the term of this patent is extended or adjusted under 35 U.S.C. 154(b) by 748 days.

(21) Appl. No.: 12/147,762

(22) Filed: Jun. 27, 2008

(65) Prior Publication Data

US 2009/0110422 A1 Apr. 30, 2009

(30) Foreign Application Priority Data

Oct. 25, 2007 (KR) ..... 10-2007-107782

(51) Int. Cl.
*G03G 15/00* (2006.01)

(52) U.S. Cl. ..... 399/49; 399/27; 399/258

(58) Field of Classification Search ..... 399/27, 399/49, 120, 258
See application file for complete search history.

(56) References Cited

U.S. PATENT DOCUMENTS

| | | | | |
|---|---|---|---|---|
| 5,475,476 | A * | 12/1995 | Murai et al. | 399/29 |
| 6,081,678 | A * | 6/2000 | Kato | 399/49 |
| 2003/0026623 | A1 * | 2/2003 | Hoshika | 399/49 |
| 2005/0271429 | A1 * | 12/2005 | Tachibana et al. | 399/301 |
| 2008/0219687 | A1 * | 9/2008 | Shinichi | 399/60 |

FOREIGN PATENT DOCUMENTS

| | | |
|---|---|---|
| JP | 8-272202 | 10/1996 |
| JP | 2006-308940 | 11/2006 |
| JP | 2007-178665 | 7/2007 |
| KR | 1998-83321 | 12/1998 |

OTHER PUBLICATIONS

Chinese Office Action dated Dec. 1, 2011 issued in CN Application No. 200810169707.X.
Korean Office Action Issued on Feb. 22, 2012 in KR Patent Application No. 10-2007-0107782.

* cited by examiner

*Primary Examiner* — Walter L Lindsay, Jr.
*Assistant Examiner* — Roy Y Yi
(74) *Attorney, Agent, or Firm* — Stanzione & Kim, LLP

(57) ABSTRACT

An image forming apparatus includes a density detector to detect a density of an image to be printed, and an image density controller to adjust a toner supply amount and a developing bias based on a detection result of the density detector to thereby adjust a density of the image.

15 Claims, 11 Drawing Sheets

IMAGE FORMING APPARATUS AND CONTROL METHOD THEREOF

CROSS-REFERENCE TO RELATED APPLICATIONS

This application claims priority under 35 U.S.C. §119(a) from Korean Patent Application No. 10-2007-0107782, filed on Oct. 25, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus to control a density of a toner supplied by a developing unit and a control method thereof, and more particularly, to an image forming apparatus which reduces consumption of a toner used to detect a density of a toner and improves halftone realization to thereby control a density of a supplied toner, and a control method thereof.

2. Description of the Related Art

Generally, a bi-component type image forming apparatus forms a toner image on a print medium with a developer having a toner forming an image and a carrier carrying the toner by a magnetic force. The image forming apparatus should be required to control a density of a toner, i.e., a mixture ratio between a toner and a carrier included in the developer to thereby supply the toner consistently for a printing job.

A conventional toner density control method counts a number of pixels in an image to be printed and controls driving time of a toner supply driving source according to the counted number of pixels to supply the toner. The conventional toner density control method estimates an amount of the consumed toner based on the number of pixels. If there is an error between the estimated toner consumption amount and the actually-supplied toner amount, the density of the toner increases or decreases by a long-term toner supplying operation.

To solve the foregoing problem, another conventional toner density control method uses a patch pattern to detect a density of a toner.

The conventional toner density control method forms a patch pattern on a photosensitive body or on an intermediate transfer body, and detects a density of the patch pattern and changes in the density to thereby adjust the toner supply amount. In this case, the patch pattern should be formed frequently to detect the density thereof and to maintain the density of an output image consistently. However, if the image pattern is frequently formed to detect the density, the toner consumption increases and the toner amount used for the image forming operation decreases. Thus, a patch pattern-forming cycle should be optimized.

The relation between the density of the toner supplied by the developing unit and the density of an image formed on the print medium will be described. If the density of the toner is higher, the density of the image is higher, too. If the density of the toner is lower, the density of the image is accordingly lower. If a determination is made according to the detection result of the patch pattern that the density of the image is low, the toner supply amount based on the number of pixels is adjusted so that more toner is supplied. If a determination is made that the density of the image is high, the toner supply amount based on the number of pixels is reduced.

However, even though the toner amount is adjusted, there is a difference between the actual toner consumption amount and the toner supply amount. Thus, if the printing job is performed under such a circumstance, the density of the toner is gradually higher or lower than a target density to make the density of the image irregular.

According to the conventional toner amount control method, the toner supply amount may be adjusted by using lookup table data. That is, the conventional toner amount control method adjusts the toner supply amount by changing the range of values used among the values in the lookup table, according to the density change of the detected patch pattern. Meanwhile, there is a time delay between a timing of determining that the density of the patch pattern is lower or higher than the target density, and a timing of getting the toner to the target density.

To prevent such a problem, the image forming operation is suspended momentarily after detecting the density of the patch pattern. If the density of the patch pattern is lower than the target density, the toner is forcibly supplied. By contrast, if the density of the patch pattern is higher than the target density, the toner is forcibly consumed. In this case, the image forming operation is suspended for a long time, thereby taking more time to form an image. Also, as the toner is forcibly consumed, the toner is wasted.

Another conventional toner density control method uses a developing bias to maintain a consistent density of an image and to prevent drastic changes in the density.

The conventional toner density control method detects a density of a toner with a patch pattern and adjusts the density of an image by controlling a developing bias. The conventional method addresses problems such as deterioration of a developer due to environmental changes or lifespan with only the developing bias. Thus, the variable ranges of the developing bias should be wide. If the developing bias is set too high, however, a carrier is developed to a photosensitive body together with the toner and the image may be deteriorated. If the developing bias is set too low, realization of halftone is lowered.

SUMMARY OF THE INVENTION

The present general inventive concept provides an image forming apparatus to adjust a density of a supplied toner and a developing bias at a same time, reduces consumption of a toner used to detect the density of the toner and improves halftone realization, and a control method thereof.

Additional aspects and/or utilities of the present general inventive concept will be set forth in part in the description which follows and, in part, will be obvious from the description, or may be learned by practice of the present general inventive concept.

The foregoing and/or other aspects and utilities of the present general inventive concept are also achieved by providing an image forming apparatus comprising a density detector to detect a density of an image to be printed, and an image density controller to adjust a toner supply amount and a developing bias based on a detection result of the density detector to thereby adjust the density of the image.

The image density controller may control the developing bias that is changed for every predetermined period, to return to a reference developing bias.

The image density controller may control the changed developing bias to gradually return to the reference developing bias for a time during which the toner supply amount reaches a target density according to an adjusted driving time of a toner supply driving source.

The timing at which the changed developing bias returns to the reference developing bias may be the timing at which the density of the image reaches the target density from a developing position by the changed toner supply amount.

The changed developing bias may be in inverse proportion to an accumulated toner amount supplied for the predetermined period from the developing position.

The predetermined period may be determined by at least one of an amount of print media, a counting value accumulating a number of pixels in a printed image and information on an accumulated toner supply amount.

The information on the accumulated toner supply amount may be calculated by accumulating a driving time or driving numbers of a toner supply driving source.

The density detector may detect the density of the image with a predetermined patch pattern formed on a photosensitive body or an intermediate transfer body.

The image forming apparatus may further comprise a counter to count a number of pixels in the image to be printed, and a toner supply controller to supply a toner based on the counting result.

The foregoing and/or other aspects and utilities of the present general inventive concept are also achieved by providing a control method of an image forming apparatus, the control method comprising detecting a density of an image to be printed, adjusting a toner supply amount based on the detection result of the density, and adjusting the density of the image by changing a developing bias.

The control method may further comprise controlling the developing bias changed at every predetermined period, to return to a reference developing bias.

The controlling the developing bias may comprise controlling the changed developing bias to gradually return to the reference developing bias for a time during which the toner supply amount reaches a target density according to an adjusted driving time of a toner supply driving source.

The timing at which the changed developing bias may return to the reference developing bias is a timing at which the density of the image reaches the target density from a developing position by the changed toner supply amount.

The changed developing bias may be in inverse proportion to an accumulated toner amount supplied for the predetermined period from the developing position.

The predetermined period may be determined by at least one of an amount of print media, a counting value accumulating a number of pixels in a printed image and information on an accumulated toner supply amount.

The information on the accumulated toner supply amount may be calculated by accumulating a driving time or driving numbers of the toner supply driving source.

The detecting the density of the image may comprise forming a predetermined patch pattern on a photosensitive body or an intermediate transfer body to detect the density of the patch pattern.

The control method may further comprise counting a number of pixels in the image to be printed and controlling the toner supply amount based on the counting result.

The foregoing and/or other aspects and utilities of the general inventive concept may also be achieved by providing an image forming apparatus including a density detector to detect a density of an image, and an image density controller to adjust a toner supply amount and a developing bias at a same time to directly adjust the density of the image based on a detection result of the density detector.

The foregoing and/or other aspects and utilities of the general inventive concept may also be achieved by providing a control method of an image forming apparatus, the control method including determining whether an image forming operation has been performed on a predetermined number of print media and, if so, forming a patch pattern, detecting a density of an image to be printed, adjusting a toner supply amount based on the detection result of the density, and adjusting the density of the image by changing a developing bias, and if the image forming operation has not been performed on the predetermined number of print media, changing an adjusted developing bias to an original reference developing bias.

The foregoing and/or other aspects and utilities of the general inventive concept may also be achieved by providing a computer-readable recording medium having embodied thereon a computer program to execute a method, wherein the method including detecting a density of an image to be printed, adjusting a toner supply amount based on the detection result of the density, and adjusting the density of the image by changing a developing bias.

The foregoing and/or other aspects and utilities of the general inventive concept may also be achieved by providing a method of adjusting a toner supply amount in an image forming apparatus, the method including detecting a density of a print pattern, identifying one or more parameter values from a lookup table corresponding to the detect density of the print pattern, and adjusting the toner supply amount based on the one or more parameter values.

The toner supply amount may be adjusted with respect to a print medium having a patch pattern that is not detected.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
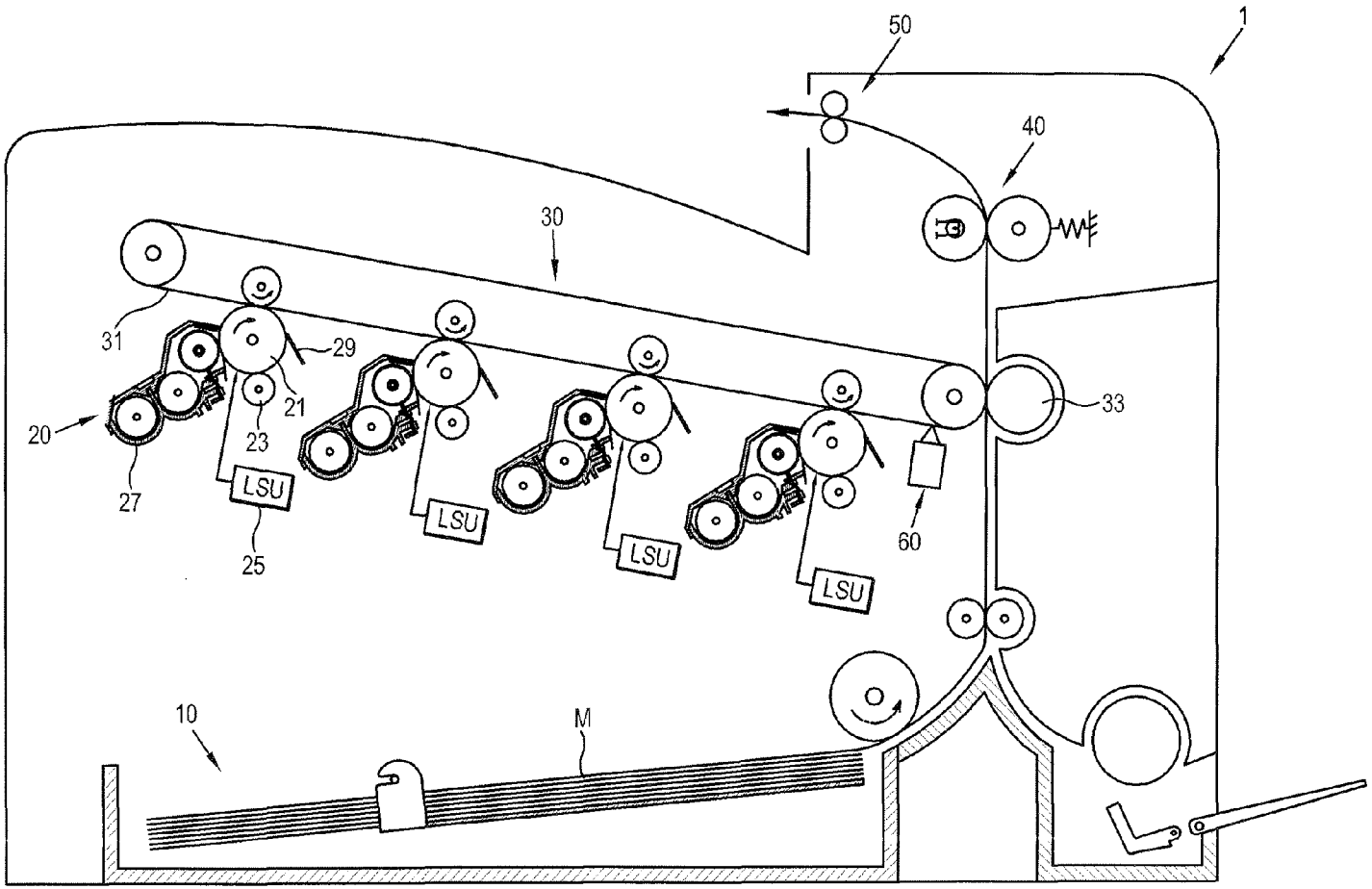
FIG. 1 illustrates an electrophotographic color printer applying an image forming apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 illustrates an electrophotographic color printer applying an image forming apparatus according to an exemplary embodiment of the present general inventive concept.

As illustrated therein, an electrophotographic color printer 1 includes a medium supply unit 10 to supply a print medium M, an image forming unit 20 to form a color image on the supplied print medium M with an electrophotographic method, a transfer unit 30 to transfer the formed color image to the print medium M, a fusing unit 40 to fuse a toner image transferred to the print medium M and a medium discharging unit 50 to discharge the print medium M.

The image forming unit 20 includes a photosensitive medium 21, a charger 23 to charge the photosensitive medium 21 with a predetermined electric potential, an exposing unit 25 to form a latent image on the photosensitive medium 21 and a developing unit 27 to develop a visible image with the latent image formed on the photosensitive medium 21. The image forming unit 20 further includes a cleaning unit 29 to remove a toner remaining in the photosensitive medium 21 after the toner image is transferred.

FIG. 1 illustrates an example of a tandem color printer. The photosensitive medium 21, the charger 23, the exposing unit 25, the developing unit 27 and the cleaning unit 29 are provided in each color on a feeding path of the print medium M. The colors include yellow, magenta, cyan and black.

The exposing unit 25 includes a light scanning unit (hereinafter, to be called LSU) to scan a light beam to each of the plurality of photosensitive media 21 provided in each color. The exposing unit 25 forms a latent image on the photosensitive media 21 charged with a predetermined electric potential by the charger 23.

The developing unit 27 supplies a toner to the photosensitive media 21 with a bi-component developing method, and forms a visible image corresponding to the latent image. The developing unit 27 uses a developer including a toner forming a image and a carrier carrying the toner with a magnetic force. The developing unit 27 divides the toner from the developer and forms a toner image on the photosensitive media 21. The amount of the toner divided from the developer and supplied to the photosensitive media 21 is influenced by a size of a developing bias applied to the developing unit 27.

The transfer unit 30 includes an intermediate transfer belt 31 facing the plurality of photosensitive media 21 and a transfer roller 33 facing the intermediate transfer belt 31, leaving the print medium M fed on a feeding path, therebetween. A visible image which is formed on each of the plurality of photosensitive media 21 is primarily transferred to the intermediate transfer belt 31 and then to the print medium M.

The fusing unit 40 fuses the image transferred to the print medium M by heat and pressure.

The color printer 1 further includes a density detector to detect a density of an image to be printed on the print medium M to thereby control the density of the image to be formed thereon.

The density detector according to the present embodiment includes a density sensor 60 which faces the intermediate transfer belt 31 and detects a density of a toner transferred to the intermediate transfer belt 31.

Figure 2:
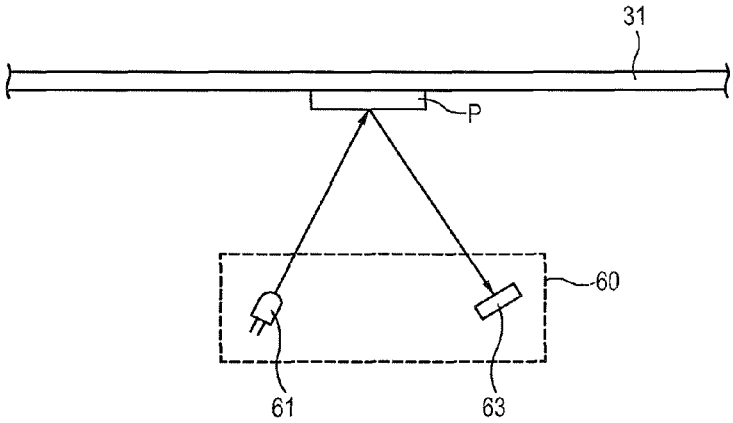
FIG. 2 illustrates a density sensor in FIG. 1.

Referring to FIG. 2, the density sensor 60 includes an optical sensor. That is, the density sensor 60 includes a light source 61 emitting light to the intermediate transfer belt 31 and a light detector 63 photoelectrically transforms light reflected by the intermediate transfer belt 31. The light source 61 includes a light emitting diode while the light detector 63 includes a photo transistor having a photo diode and a transistor.

The density sensor 60 detects the density of the toner on the patch pattern P formed by a toner image on the intermediate transfer belt 31, based on the received light amount.

The patch pattern P is formed by a following method. Typically, the patch pattern P is formed when a print result is changed or when the change is likely to happen. The patch pattern P is formed by an additional process after an image forming operation is suspended or formed on a predetermined position of the intermediate transfer belt 31 corresponding to a margin between the print media M during a printing job. The patch pattern P may be formed by an image pattern stored in a main body of the color printer 1.

Figure 3:
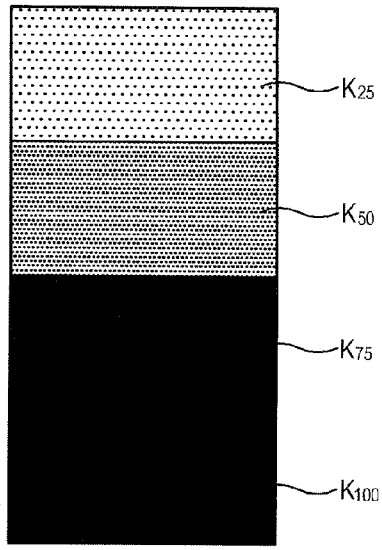
FIG. 3 illustrates an example of a patch pattern formed on an intermediate transfer belt in FIG. 1.

FIG. 3 illustrates an example of the patch pattern P. $K_{25}$ refers to a 25% pattern, $K_{50}$ is a 50% pattern, $K_{75}$ is a 75% pattern and $K_{100}$ refers to a 100% pattern. The $K_{100}$ pattern is used to adjust the density of the image while the $K_{25}$, $K_{50}$ and $K_{75}$ patterns are used to adjust a property of a gray scale.

The patch patterns P are formed according to each color. The density of the patch patterns P is detected by the density sensor 60 in FIG. 2 to adjust the density of the image or to adjust the property of the gray scale.

Figure 4:
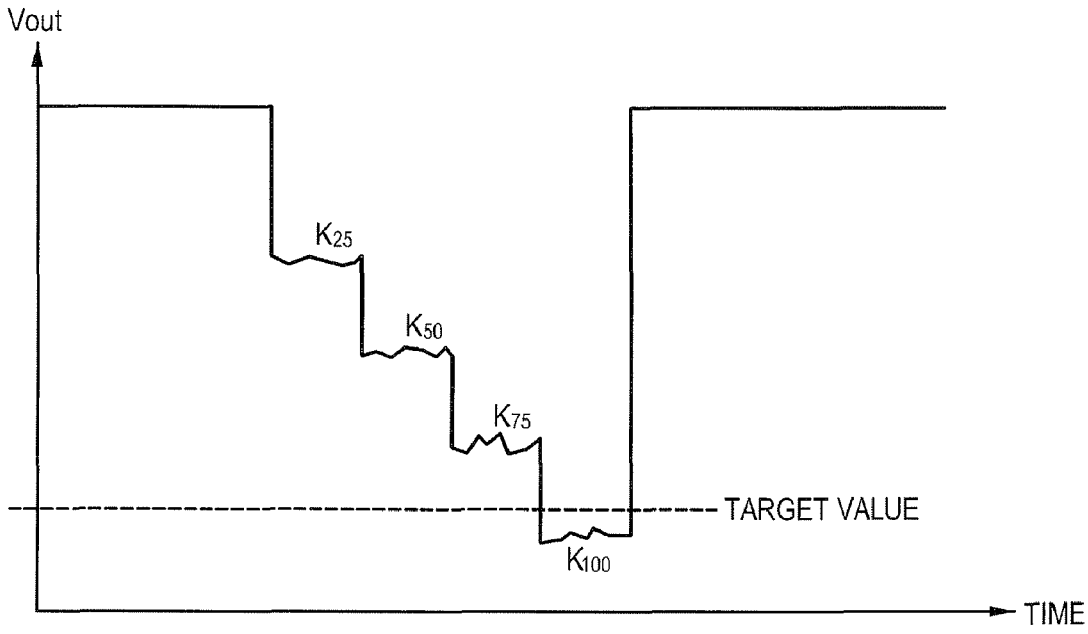
FIG. 4 illustrates an example of a waveform of the patch pattern formed on the intermediate transfer belt and detected by the density sensor according to an exemplary embodiment of the present general inventive concept.

FIG. 4 illustrates an example of a waveform if the patch patterns P formed on the intermediate transfer belt 31 are detected by the density sensor 60.

The density of the $K_{25}$ to $K_{100}$ patterns is detected by changes in an output voltage $V_{out}$ output through the light detector 63 according to the patch pattern P.

If the density of the toner (mixture rate of the toner) is high in the developer, the toner attachment amount increases to reduce the light amount reflected from the patch patterns P. Thus, the output voltage $V_{out}$ is reduced to a target value and below.

If the density of the toner is low in the developer, the toner attachment amount decreases. Thus, the light amount reflected from the patch patterns P increases to raise the output voltage $V_{out}$ above the target value. The density of the toner may be adjusted by adjusting the toner amount included in the developer depending on the detection result of the output voltage $V_{out}$.

FIGS. 2 to 4 illustrate a reflective optical element as an example of the density sensor 60. The color printer 1 according to an embodiment of the present general inventive concept may employ a transmission type optical element as the density sensor 60. In this case, the waveform of an output voltage $V_{out}$ is translated, contrary to the result in FIG. 4.

The density detector according to an embodiment of the present general inventive concept is not limited to the density sensor 60, and may vary within the scope of the present general inventive concept.

Figure 5:
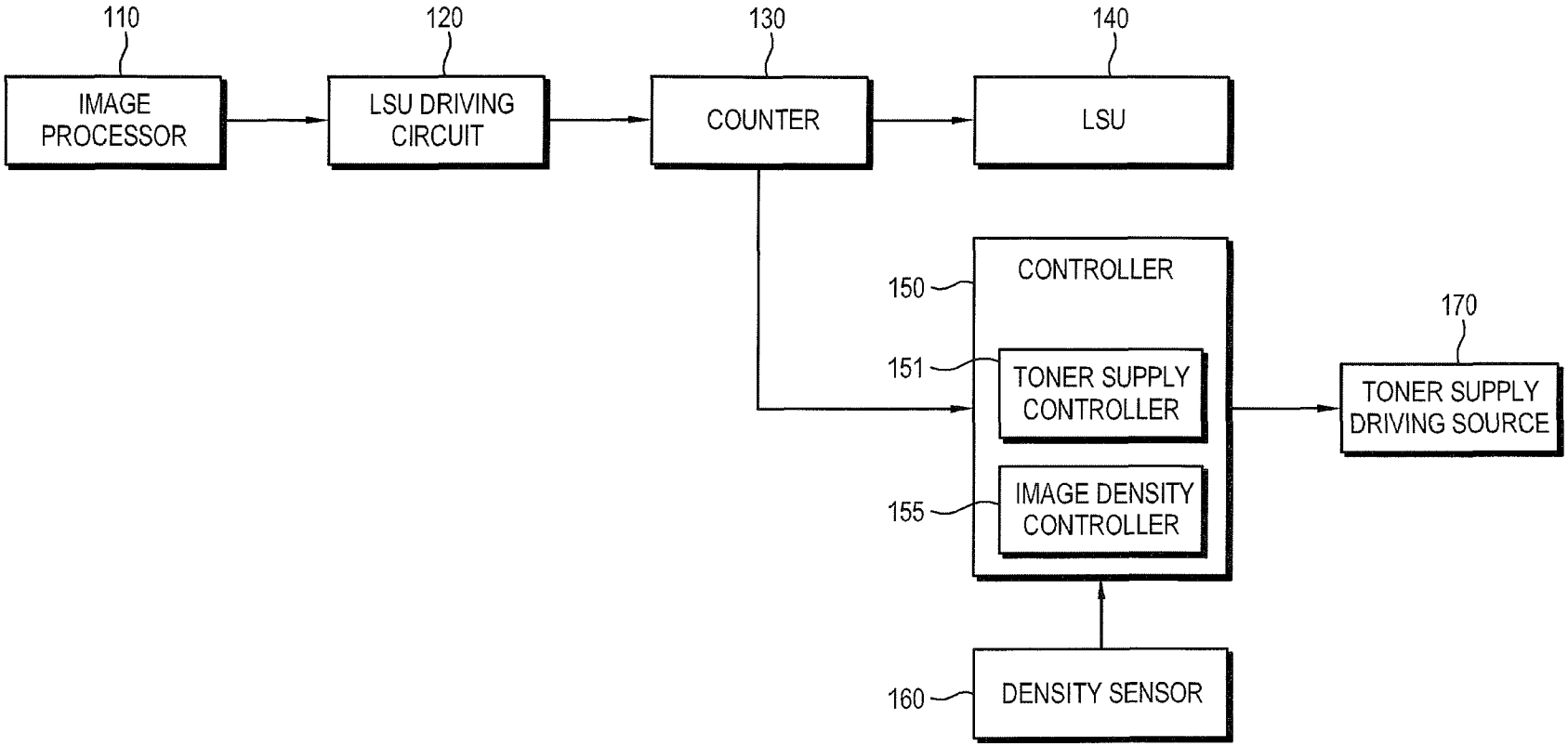
FIG. 5 is a block diagram of the image forming apparatus according to a exemplary embodiment of the present general inventive concept.

FIG. 5 is a block diagram illustrating the image forming apparatus according to an exemplary embodiment of the present general inventive concept.

Referring to FIGS. 1 and 5, the image forming apparatus according to the exemplary embodiment of the present general inventive concept includes a counter 130 to count a number of pixels in an image to be printed, a controller 150 and the density sensor 160. The controller 150 includes a toner supply controller 151 to control a toner supply amount based on the number of pixels counted by the counter 130, and an image density controller 155 to control the density of the image.

Hereinafter, a process of controlling the density of the toner of the image forming apparatus according to an exemplary embodiment of the present general inventive concept will be described. Image data which are supplied by a host computer (not illustrated) are processed by an image processor 110. The image processor 110 processes an image such as gray scale adjustment and color realization adjustment. The processed image data are input to an LSU driving circuit 120. The LSU driving circuit 120 generates a signal to drive the LSU 140 based on the input image data. The counter 130 receives the driving signal from the LSU driving circuit 120 and counts data. According to the present embodiment, the counter 130 counts the image data including a one-page printing medium as a single image data unit.

The density sensor 160 detects the density of the predetermined patch pattern P formed on the photosensitive body or the intermediate transfer body. As an example of the present general inventive concept, the photosensitive body and the intermediate transfer body are the photosensitive medium 21 and the intermediate transfer belt 31 in FIG. 1, respectively. The patch pattern P is formed by the image forming unit 20 in FIG. 1.

The reference numeral 170 refers to the toner supply driving source. The toner supply driving source 170 is controlled by the toner supply controller 151 and supplies the toner to the developing unit 27 (refer to FIG. 1).

Meanwhile, the counter 130 and the toner supply controller 151 is described as elements to control the toner supply amount, but not limited thereto. Alternatively, toner supply elements may vary.

The image density controller 155 adjusts the toner supply amount based on the detection result of the density of the patch pattern P in every predetermined period and adjusts the developing bias to control the density of the image.

The image density controller 155 controls the developing bias changed in every predetermined period to return to a reference developing bias to thereby adjust the density of the image. The reference developing bias may be substantially equivalent to the developing bias before changed. The reference developing bias may include a developing bias which is reset according to a developing condition, differently from the developing bias before changed.

The image density controller 155, for example, may control the changed developing bias to gradually return to the reference developing bias until the toner supply amount reaches the target density according to the changed driving time of the toner supply driving source 170. Here, the returning timing of the changed developing bias may be the timing where the density of the image reaches the target density by changing the toner supply amount. A detailed description will be provided later with reference to FIGS. 7A to 7C.

The changed developing bias may be in inverse proportion to the accumulated amount of the toner supplied for a predetermined time.

Figure 6:
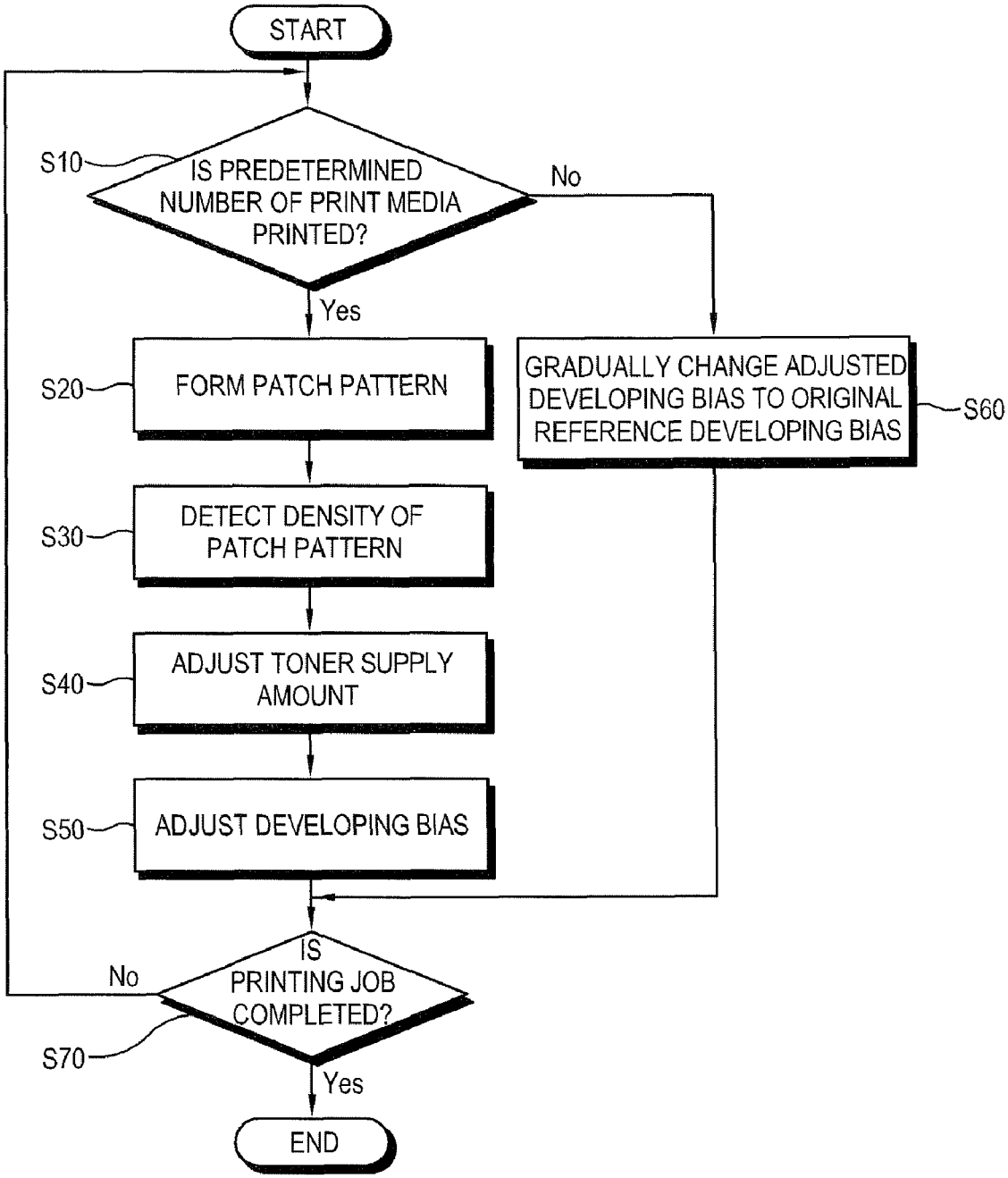
FIG. 6 is a flowchart illustrates a control method of the image forming apparatus according to an exemplary embodiment of the present general inventive concept.

FIG. 6 is a flowchart illustrating a control method of the image forming apparatus according to the exemplary embodiment of the present general inventive concept. Referring to FIGS. 1, 5 and 6, the controller 150 determines whether a predetermined amount of print media M, i.e. a single print medium M is printed (operation S10). The counter 130 counts the number of pixels in the image formed on the predetermined amount of the print media M and the controller 150 controls the toner supply amount based on the counting result to form an image until the predetermined amount of the print media M is printed.

The completion of the printing job refers to the completion of exposing the electrostatic latent image of the photosensitive medium 21 through the LSU rather than the discharge of the printed print medium M. That is, the completion of the printing job refers to the completion of counting the number of pixels in the image.

More specifically, after the predetermined amount of the print media M is printed, the counter 130 counts the number of pixels and the controller 150 determines the driving time of the toner supply driving source 170 with the lookup table (hereinafter, to be called LUT) to supply the toner at operation S10. Here, the detection result of the density of the patch pattern P detected from a previous operation is also used. The controller 150 controls the toner supply driving source 170 to control the toner supply amount.

Hereinafter, application of the LUT values will be described. Table 1 illustrates detailed examples of the LUT.

TABLE 1

| | | ←High density | | | | | | Low density → |
|---|---|---|---|---|---|---|---|---|
| | | Output voltage of density sensor | | | | | | |
| Dot | Coverage | 0.5 V | 0.6 V | 0.7 V | 0.8 V | 0.9 V | 1.0 V | 1.1 V |
| 348025 | 1% | 35 ms | 40 ms | 45 ms | 50 ms | 55 ms | 60 ms | 65 ms |
| 696051 | 2% | 70 ms | 80 ms | 90 ms | 100 ms | 110 ms | 120 ms | 130 ms |
| 1044076 | 3% | 105 ms | 120 ms | 135 ms | 150 ms | 165 ms | 180 ms | 195 ms |
| 1392101 | 4% | 140 ms | 160 ms | 180 ms | 200 ms | 220 ms | 240 ms | 260 ms |
| 1740126 | 5% | 175 ms | 200 ms | 225 ms | 250 ms | 275 ms | 300 ms | 325 ms |
| 2088152 | 6% | 210 ms | 240 ms | 270 ms | 300 ms | 330 ms | 360 ms | 390 ms |
| 2436177 | 7% | 245 ms | 280 ms | 315 ms | 350 ms | 385 ms | 420 ms | 455 ms |
| 2784202 | 8% | 280 ms | 320 ms | 360 ms | 400 ms | 440 ms | 480 ms | 520 ms |
| 3132228 | 9% | 315 ms | 360 ms | 405 ms | 450 ms | 495 ms | 540 ms | 585 ms |
| 3480253 | 10% | 350 ms | 400 ms | 450 ms | 500 ms | 550 ms | 600 ms | 650 ms |
| 3828278 | 11% | 385 ms | 440 ms | 495 ms | 550 ms | 605 ms | 660 ms | 715 ms |
| 4176304 | 12% | 420 ms | 480 ms | 540 ms | 600 ms | 660 ms | 720 ms | 780 ms |
| 4524329 | 13% | 455 ms | 520 ms | 585 ms | 650 ms | 710 ms | 780 ms | 845 ms |
| 4872354 | 14% | 490 ms | 560 ms | 630 ms | 700 ms | 770 ms | 840 ms | 910 ms |
| 5220379 | 15% | 525 ms | 600 ms | 675 ms | 750 ms | 825 ms | 900 ms | 975 ms |
| 5568405 | 16% | 560 ms | 640 ms | 720 ms | 800 ms | 880 ms | 960 ms | 1040 ms |
| 5916430 | 17% | 595 ms | 680 ms | 765 ms | 850 ms | 935 ms | 1020 ms | 1105 ms |
| 6264455 | 18% | 630 ms | 720 ms | 810 ms | 900 ms | 990 ms | 1080 ms | 1170 ms |
| 6612481 | 19% | 665 ms | 760 ms | 855 ms | 950 ms | 1045 ms | 1140 ms | 1235 ms |
| 6960506 | 20% | 700 ms | 800 ms | 900 ms | 1000 ms | 1100 ms | 1200 ms | 1300 ms |
| . | . | . | . | . | . | . | . | . |
| . | . | . | . | . | . | . | . | . |
| . | . | . | . | . | . | . | . | . |
| | | A | B | C | D | E | F | G |

In Table 1, a dot refers to the number of pixels in an image to be printed in a single sheet of paper. A coverage refers to a ratio of a total area of an image with respect to a total area of a print medium M. The relation between the dot and coverage differs depending on resolution and paper size. As an example of the present general inventive concept, the resolution is 600 dpi and the paper size is A4.

An output voltage of the density sensor refers to an output voltage of the density sensor 160. Table 1 illustrates the output voltage ranging from 0.5V to 1.1V, and LUT values from A to G. Here, 0.5V refers to a high density and 1.1V refers to a low density. The figures of the output voltage of the density sensor 160 refer to driving time of the toner supply driving source 170.

In Table 1, if the detected density of the patch pattern P is 0.8V, the toner supply is controlled by using the LUT in a row D. For example, if the number of pixels in image data to be printed is 1740126 dots (corresponding to 5% coverage), the driving time of the toner supply driving source 170 is 250 ms. The LUT is used to print each page, and the patch pattern P is formed and detected once per 50 to 100 print media M to reduce consumption of the toner. Thus, the toner supply is controlled by using the LUT value of the patch pattern P with respect to the print medium M whose patch pattern P is not detected.

If a determination is made at operation S10 that the predetermined amount of print media M is printed, the LSU 140 is driven with the image data corresponding to the patch pattern P, and the patch pattern P is formed on the photosensitive body 21 or the intermediate transfer body 31 (operation S20). The density sensor 160 detects the density of the patch pattern P.

The controller 150 adjusts a toner supply amount that will be supplied later based on the detection result of the density of the patch pattern P (operation S40). That is, the controller 150 determines the LUT value used to supply the toner to a subsequent page. For example, the LUT value used to supply the toner is selected from one of rows A to G.

The controller 150 determines the adjusted amount of the developing bias according to the difference from the reference density, and controls the image density by changing the developing bias (operation S50).

At operation S60, the developing bias which is changed in every predetermined period is controlled to return to the reference developing bias. The controller 150 controls the developing bias to gradually return to the reference developing bias according to the detected density. The controller 150 determines whether the printing job is completed (operation S70). If the printing job is not completed, the operations S10 to S60 may be repeated depending on the determination.

Figure 7A:
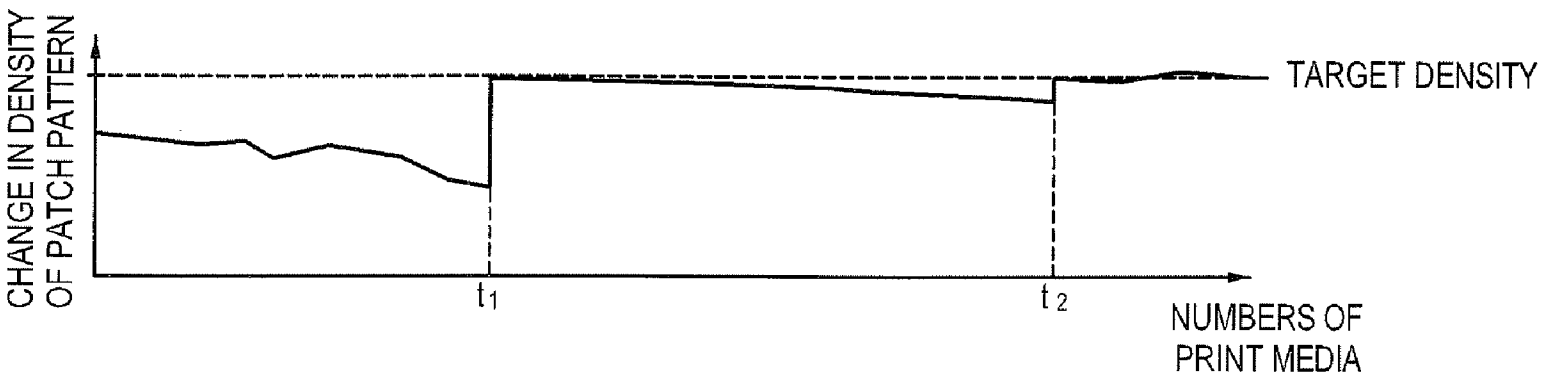
FIGS. 7A to 7C are graphs which illustrate changes in a density of the patch pattern, changes in a developing bias and changes in a supplied LUT according to an increased print media.
Figure 7B:
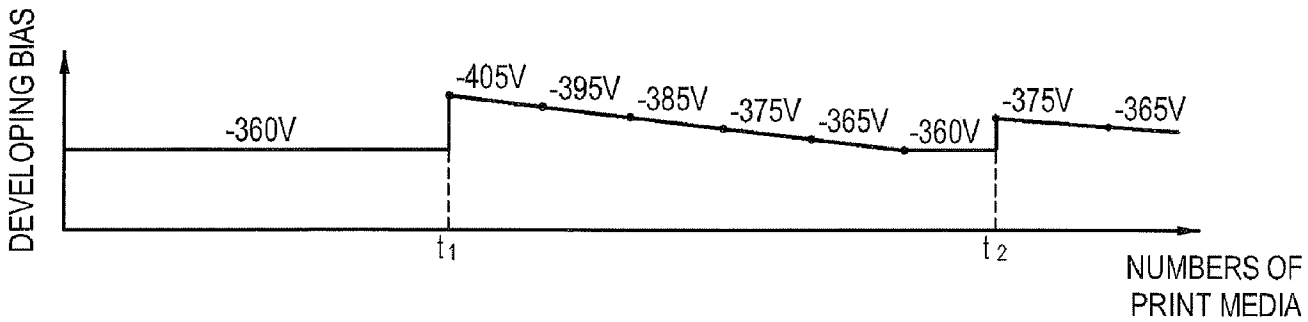
Figure 7C:
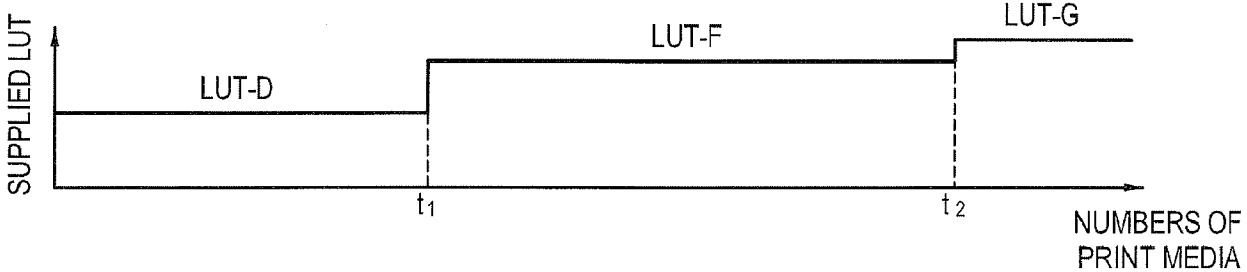

Referring to FIGS. 7A to 7C, the changes in the density, the developing bias and the supplied LUT after the image density is controlled according to the image forming apparatus according to the exemplary embodiment of the present general inventive concept and the control method thereof will be described.

FIGS. 7A to 7C illustrate changes in the density of the patch pattern P, changes in the developing bias and changes in the supplied LUT according to an increased amount of the print media M. As illustrated therein, $t_1$ and $t_2$ refer to respective timings at which the detected density of the image with respect to the patch pattern P is lower than the target density (reference value).

If the density of the patch pattern P is lower than the target density at the timing $t_1$, the toner supply LUT is changed from data LUT-D in a row D to data LUT-F in a row F and at the same time the developing bias is changed.

If the toner supply LUT is changed at the timing $t_1$ to adjust the driving time of the toner supply driving source 170, the toner supply amount increases gradually to cause time delay Δt from the developing position to reach the target density. The time delay Δt also includes a delay due to a distance between the toner supply position and the developing position.

The present general inventive concept changes the toner supply LUT and the developing bias at a same time to address the time delay problem.

Figure 8:
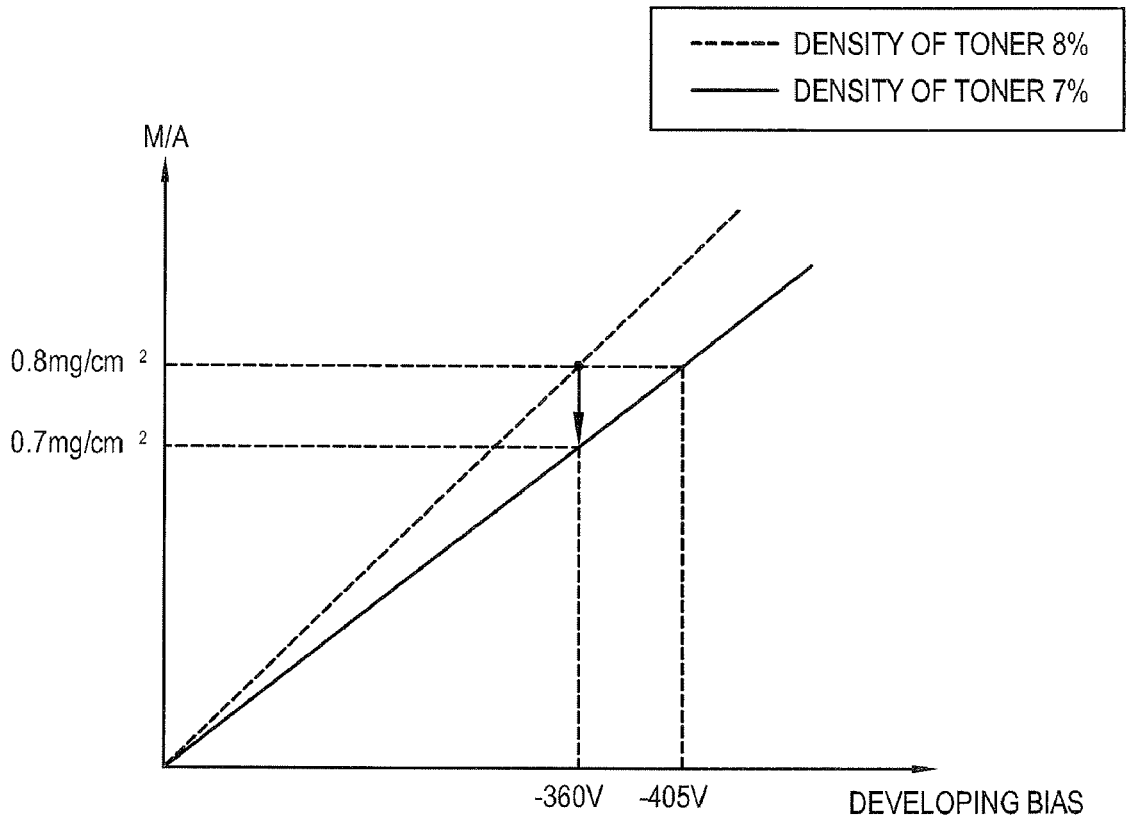
FIG. 8 is a graph which illustrates a relation between a toner amount (M/A) and the developing bias according to an example of the present general inventive concept.

As illustrated in FIG. 8, the relation between the developing bias and the toner amount M/A differs depending on the density of the toner. Hereinafter, the changed amount of the developing bias at the timing $t_1$ will be described in detail.

FIG. 8 illustrates an example of the relation between the developing bias and the toner amount M/A. If the density of the toner is 8% and the developing bias is −360V, the toner amount is 0.8 mg/cm$^2$. The toner amount is in proportion to the size of the developing bias.

If the density of the toner is 7% and the developing bias is −360V, the toner amount is 0.7 mg/cm$^2$, which is lower than when the density of the toner is 8%. If the density of the toner is 7% and the developing bias is −405V, the toner amount is 0.8 mg/cm$^2$, which is the same as that when the density of the toner is 8% and the developing bias is −360V.

That is, the density of the toner is lowered by other factors than the developing bias. If the lowered density is detected by the density sensor 160, the image density controller 155 adjusts the developing bias to control the toner amount from the timing of detecting the lowered density of the toner.

Table 2 illustrates a relation between the output voltage of the density sensor 160 and the adjusted voltage amount of the developing bias. The output voltage of the density sensor 160 is in proportion to the toner amount supplied to the transfer unit 30. For example, if the current developing bias is −360V, the developing bias is adjusted by −45V to be −405V at the timing $t_1$. Then, the toner amount increases from 0.700 mg/cm$^2$ to 0.800 mg/cm$^2$.

TABLE 2

| Output voltage of density sensor (toner amount(M/A)) | Adjusted voltage amount for current developing bias | | | | |
|---|---|---|---|---|---|
| | Current −320 V | Current −340 V | Current −360 V | Current −380 V | Current −400 V |
| 1.8 V (0.600 mg/cm$^2$) | −78 V | −84 V | −90 V | −96 V | −102 V |
| 1.9 V (0.633 mg/cm$^2$) | −65 V | −70 V | −75 V | −80 V | −85 V |
| 2.0 V (0.637 mg/cm$^2$) | −52 V | −56 V | −60 V | −64 V | −68 V |
| 2.1 V (0.700 mg/cm$^2$) | −39 V | −42 V | −45 V | −48 V | −51 V |
| 2.2 V (0.733 mg/cm$^2$) | −26 V | −28 V | −30 V | −32 V | −34 V |
| 2.3 V (0.767 mg/cm$^2$) | −13 V | −14 V | −15 V | −16 V | −17 V |
| 2.4 V (0.800 mg/cm$^2$) | 0 V | 0 V | 0 V | 0 V | 0 V |
| 2.5 V (0.833 mg/cm$^2$) | 13 V | 14 V | 15 V | 16 V | 17 V |
| 2.6 V (0.867 mg/cm$^2$) | 26 V | 28 V | 30 V | 32 V | 34 V |
| 2.7 V (0.900 mg/cm$^2$) | 39 V | 42 V | 45 V | 48 V | 51 V |

As described above, the developing bias is directly adjusted, and the density of the image with respect to the patch pattern P is adjusted at the timing $t_1$ without the time delay.

Between the timings $t_1$ and $t_2$, the supplied LUT value maintains the data LUT-F determined at the timing $t_1$. As the data LUT-F of the changed supplied LUT are maintained, the density of the developer in the developing unit 27 is gradually adjusted to raise the density of the image.

The image density controller 155 controls the developing bias to be gradually changed to the reference developing bias value between the timings $t_1$ and $t_2$. That is, the image density controller 155 controls the developing bias to be the reference developing bias at the time Δt to make the toner supply amount reach the target density according to the adjusted driving time of the toner supply driving source 170.

For example, from the timing $t_1$ to the timing $t_2$ is divided into six periods, and the developing bias is reduced by −10V or −5V at each period. The developing bias is controlled to be the reference developing bias (−360V in FIG. 7B) from the timing $t_1$ and after the time Δt. Thus, the increased density of the image by the supplied LUT may be offset.

Thus, the density of the image may maintain a value adjacent to the target density between the timings $t_1$ and $t_2$. As the developing bias returns to the reference developing bias after a predetermined time, errors due to the changed developing bias may be prevented after the patch pattern P is detected.

If the detected density is lower than the target density at the timing $t_2$, the toner supply LUT is changed from the data LUT-F in a row F to data LUT-G in a row G and at the same time the developing bias is changed. For example, the developing bias is changed from −360V to −375. Other processes are equivalent to the processes described above. Thus, a detailed description will be avoided.

According to the present embodiment, the developing bias gradually returns to the reference developing bias for every predetermined amount of the print media M, but not limited thereto.

According to another exemplary embodiment, the developing bias may return to the reference developing bias based on information on accumulated counting value of the number of pixels in an image to be printed. More specifically, the image density controller 155 may control the developing bias to return to the reference developing bias in every accumulated value of pixels.

According to another exemplary embodiment, the developing bias may be controlled based on information on the accumulated toner supply amount.

That is, if the toner accumulation information is in every predetermined state, the image density controller 155 may control the developing bias to return to the reference developing bias. Here, the information on the accumulated toner supply amount may be calculated by accumulating the driving time or the driving numbers of the toner supply driving source 170.

Figure 9:
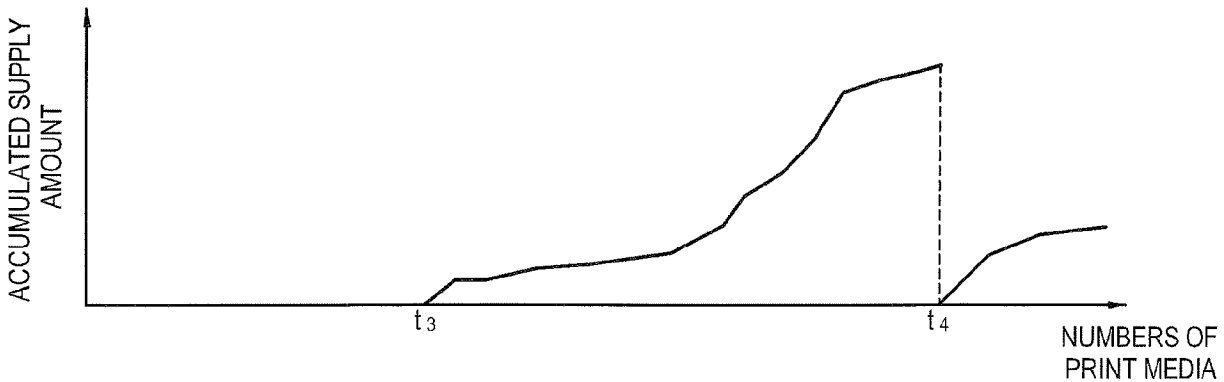
FIG. 9 is a graph which illustrates the developing bias controlled depending on changes in the accumulated supply amount of the toner.

FIG. 9 illustrates an adjustment of the developing bias depending on the changes in the accumulated supply amount. Referring to FIGS. 7A-7C and 9, the toner supply time or the toner supply numbers are accumulated from the timing $t_1$ to achieve the information on the accumulated toner supply amount. The accumulated toner supply amount one-to-one corresponds to the changes in the density of the toner to thereby control the developing bias. The accumulated toner supply amount is rest at the timing $t_2$, and accumulated again according to an elapsed amount of time.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, the image forming apparatus and the control method thereof according to various embodiments of the present general inventive concept adjusts the toner supply amount and the developing bias at a same time based on the detected density of the image to directly adjust the density of the image. Thus, the time delay does not occur. As the patch pattern P is detected, for example, in response to an event such as after printing or scanning 50 to 100 print media M to detect the density of the image, the toner consumption for the patch pattern may be reduced. As the changed developing bias gradually returns to the reference developing bias, the image quality may be maintained stably during the period after the patch pattern is detected and before a subsequent patch pattern is detected.

Although various exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

a density detector to detect a density of an image to be printed;

a counter to count a number of pixels in the image to be printed; and a controller to adjust a toner supply amount and a developing bias based on a detection result of the density detector and the counted number of pixels in the image to be printed to thereby adjust the density of the image, wherein the toner supply amount is adjusted by adjusting a driving time of a toner supply driving source, wherein the controller adjusts the development bias each predetermined period of time and controls the adjusted development bias to gradually return to a reference development bias during each predetermined period of time.

2. The image forming apparatus according to claim 1, wherein the timing at which the changed developing bias returns to the reference developing bias is the timing at which the density of the image reaches a target density from a developing position by the changed toner supply amount.

3. The image forming apparatus according to claim 1, wherein the changed developing bias is in inverse proportion to an accumulated toner amount supplied for the predetermined period from the developing position.

4. The image forming apparatus according to claim 1, wherein the predetermined period is determined by at least one of an amount of print media, a counting value accumulating a number of pixels in a printed image and information on an accumulated toner supply amount.

5. The image forming apparatus according to claim 4, wherein the information on the accumulated toner supply amount is calculated by accumulating the driving time or driving numbers of the toner supply driving source.

6. The image forming apparatus according to claim 1, wherein the density detector detects the density of the image with a predetermined patch pattern formed on a photosensitive body or an intermediate transfer body.

7. A control method of an image forming apparatus, the control method comprising:

detecting a density of an image to be printed;

counting a number of pixels in the image to be printed;

adjusting a toner supply amount based on the detection result of the density and the counted number of pixels of the image to be printed, wherein the toner supply amount is adjusted by adjusting a driving time of a toner supply driving source; and adjusting the density of the image by changing a developing bias each predetermined period of time; and controlling the changed development bias to gradually return to a reference development bias during each predetermined period of time.

8. The control method according to claim 7, wherein the timing at which the changed developing bias returns to the reference developing bias is the timing at which the density of the image reaches a target density from a developing position by the changed toner supply amount.

9. The control method according to claim 7, wherein the changed developing bias is in inverse proportion to an accumulated toner amount supplied for the predetermined period from the developing position.

10. The control method according to claim 7, wherein the predetermined period is determined by at least one of an amount of print media, a counting value accumulating a number of pixels in a printed image and information on an accumulated toner supply amount.

11. The control method according to claim 10, wherein the information on the accumulated toner supply amount is calculated by accumulating the driving time or driving numbers of the toner supply driving source.

12. The control method according to claim 7, wherein the detecting the density of the image comprises:

forming a predetermined patch pattern on a photosensitive body or an intermediate transfer body to detect the density of the patch pattern.

13. An image forming apparatus, comprising:

a density detector to detect a density of an image;

a counter to count a number of pixels in the image to be printed; and a controller to adjust a toner supply amount and a developing bias at a same time to directly adjust the density of the image based on a detection result of the density detector and the counted number of pixels of the image to be printed, wherein the toner supply amount is adjusted by adjusting a driving time of a toner supply driving source, wherein the controller adjusts the development bias each predetermined period of time and controls the adjusted development bias to gradually return to a reference development bias during each predetermined period of time.

14. A control method of an image forming apparatus, the control method comprising:

determining whether an image forming operation has been performed on a predetermined number of print media and, if so:

forming a patch pattern;

detecting a density of an image to be printed;

counting a number of pixels in the image to be printed;

adjusting a toner supply amount based on the detection result of the density and the counted number of pixels in the image to be printed, wherein the toner supply amount is adjusted by adjusting a driving time of a toner supply driving source; and adjusting the density of the image by changing a developing bias each predetermined number of print media; and while the image forming operation is performed on the predetermined number of print media, controlling the changed developing bias to gradually return to an original reference developing bias.

15. A non-transitory computer-readable recording medium having embodied thereon a computer program to execute a method, wherein the method comprises:

detecting a density of an image to be printed;

counting a number of pixels in the image to be printed;

adjusting a toner supply amount based on the detection result of the density and the counted number of pixels in the image to be printed, wherein the toner supply amount is adjusted by adjusting a driving time of a toner supply driving source; and adjusting the density of the image by changing a developing bias each predetermined period of time; and controlling the changed development bias to gradually return to a reference development bias during each predetermined period of time.

* * * * *